US007328568B2

(12) United States Patent
Rahn

(10) Patent No.: US 7,328,568 B2
(45) Date of Patent: Feb. 12, 2008

(54) DEVICE AND METHOD FOR CORRECTING A FLEXIBLE MATERIAL WEB GUIDED TO A PROCESSING MACHINE

(75) Inventor: Roberto Rahn, Enkenbach-Alsenborn (DE)

(73) Assignee: TTEC Invest AG, Arbon (CH)

( * ) Notice: Subject to any disclaimer, the term of this patent is extended or adjusted under 35 U.S.C. 154(b) by 313 days.

(21) Appl. No.: 10/510,420

(22) PCT Filed: Apr. 11, 2003

(86) PCT No.: PCT/DE03/01217

§ 371 (c)(1),
(2), (4) Date: Oct. 6, 2004

(87) PCT Pub. No.: WO03/086924

PCT Pub. Date: Oct. 23, 2003

(65) Prior Publication Data

US 2005/0224548 A1 Oct. 13, 2005

(30) Foreign Application Priority Data

Apr. 12, 2002 (DE) ..... 102 16 419

(51) Int. Cl.
*D02G 3/06* (2006.01)

(52) U.S. Cl. ..... 57/31

(58) Field of Classification Search ..... 57/31, 57/260

See application file for complete search history.

(56) References Cited

U.S. PATENT DOCUMENTS 1,178,566 A * 4/1916 Wright ..... 242/128
1,333,147 A * 3/1920 Wright ..... 242/128
2,821,387 A 1/1958 Faeber
3,285,446 A * 11/1966 Strickland ..... 414/431
4,212,422 A 7/1980 Rauchfuss et al.
5,108,022 A * 4/1992 Birkmair et al. ..... 242/615.21
5,315,461 A 5/1994 Todd
6,735,933 B2 * 5/2004 Abba et al. ..... 57/2.3
7,065,948 B2 * 6/2006 Kranich et al. ..... 57/31

FOREIGN PATENT DOCUMENTS

| | | |
|---|---|---|
| DE | 2 137 706 | 2/1973 |
| DE | 38 16 900 | 11/1989 |
| DE | 40 11 405 | 10/1991 |
| DE | 101 25 452 | 12/2002 |
| EP | 0 91 0542 | 12/1998 |
| JP | 58-202242 | 11/1983 |
| NL | 61329 | 7/1948 |

* cited by examiner

*Primary Examiner*—Shaun R. Hurley
(74) *Attorney, Agent, or Firm*—Reed Smith, LLP

(57) ABSTRACT

A device for correcting a flexible material web that is guided to a processing machine, wherein the underside of the material web incorrectly points upward due to wrongly connected web ends or due to twisting. The device comprises a rotatable pair of cylinders that is arranged on a rotating device fixed on a frame and causes the material web to be turned by 180° about its longitudinal axis such that the underside of the material web once again correctly point downward. The device also comprises a stationary pairs of cylinders that are respectively arranged upstream and downstream of the rotatable pair of cylinders, particularly in the region of the respective face sides of the frame. The rotatable pair of cylinders can be displaced along the frame and the cylinders of the first and/or the second stationary pair of cylinders and of the rotatable pair of cylinders can be moved into an open position and a closed position.

35 Claims, 3 Drawing Sheets

DEVICE AND METHOD FOR CORRECTING A FLEXIBLE MATERIAL WEB GUIDED TO A PROCESSING MACHINE

CROSS REFERENCE TO RELATED APPLICATIONS

This application claims priority of PCT Application Ser. No. PCT/DE03/01217, filed Apr. 11, 2003 and German Application No. 102 16 419.3, filed Apr. 12, 2002, the complete disclosures of which are hereby incorporated by reference.

BACKGROUND OF THE INVENTION a) Field of the Invention

The present invention pertains to a device and a method for correcting a flexible material web that is guided to a processing machine, wherein the underside of the material web incorrectly points upward due to wrongly connected web ends or due to twisting, and wherein the material web is turned at least once about its longitudinal axis in such a way that the underside of the material web once again correctly points downward and the correct upper side of the material web is transported to the processing machine.

b) Description of the Related Art

Half-finished materials in the form of strips are increasingly utilized, in particular, in the hygiene industry. The material webs have a width between approximately 25 mm and 200 mm. The material webs usually consist of bonded webs, foils, papers, airlaids or composites of the aforementioned materials. These material webs have a significant thickness between approximately 0.5 mm and 5 mm and consequently can only be wound up into a roll conditionally. This led to the development of a packaging concept, according to which the material web is either placed on a pallet or into a cardboard box in layers in a zigzag-like fashion or precut and plaited into a rectangular stack consisting of individual webs that lie parallel to one another. According to the pertinent terminology, this technique is also referred to as "festooning." Drawings of corresponding stacks can be found, for example, in DE 101 25 452 A1 or publication EP 091 0542 B1. The ends of the individual parallel or zigzag-shaped material webs are connected to one another, for example, by means of bonding or sewing in order to allow a largely continuous supply to the processing machine and to minimize downtimes. The processing machines may consist, for example, of machines for manufacturing panty liners, sanitary napkins or baby diapers.

During the removal of the material web from the festooned pack, the high supply and removal speeds on the order of approximately 300 m/min cause the material web to oscillate and vibrate and, as a consequence thereof, lead to a rotation of the material web that is also referred to as a "twist" according to the pertinent terminology. Another problem arises if the ends of the material webs were wrongly connected to one another and the upper side of the material web that should be provided, for example, with an impregnation in the processing machine points downward. The twists and the wrongly connected ends of the material web ultimately lead to a non-functional end product due to the inverted upper side and underside of the material web. Twists can also lead to tearing of the material web. This also results in the downtimes of the processing machine and the accumulation of costly waste of a high-quality and expensive half-finished material.

Only a manual correction of twists or wrongly connected material ends is known from the state of the art. This manual correction is very limited and ultimately associated with downtimes of the processing machine. The twist is corrected by turning the material web about its longitudinal axis, namely in the opposite direction, and ultimately controlling that the undesirable twist continues to the free end of the material web. Alternately, an intentional twisting is carried out in order to introduce the correct upper side of the material web into the processing machine. This also is also associated with downtimes of the processing machines and with a significant expenditure of labor.

The pertinent state of the art—U.S. Pat. Nos. 4,212,422, 2,821,387, DE 2 137 706 B2—pertains to, for example, devices and methods in which deflection rolls are supported in a pivoted fashion and the twist of the web is corrected by adapting the cylinder position to the degree of twisting. The defect of the supplied web is limited to deviations in the directional transport in the state of the art. In addition, only a flexible reaction of deflection rolls that are supported in a pivoted fashion to a supply sensor takes place in this case rather than an untwisting of the web.

OBJECT AND SUMMARY OF THE INVENTION

Based on this state of the art, the invention aims to disclose a device and a method of the initially cited type that allow a correction of a flexible material web that is guided to a processing machine and the underside of which incorrectly points upward, wherein the accumulation of half-finished material waste as well as downtimes of the processing machine should simultaneously be reduced. According to preferred embodiments, downtimes of the processing machines should be entirely eliminated, and an automation of the supply should be achieved in connection with the correction of the twisted material web.

With respect to the above-mentioned device, this objective is attained with the characteristics of the present invention. According to these characteristics, a device of the initially cited type is equipped with a rotatable pair of cylinders that causes a correcting rotation of the material web about its longitudinal axis in such a way that the underside of the material web once again correctly point downward.

According to the invention, it was recognized that the arrangement of a rotatable pair of cylinders upstream of the processing machine already provides the advantageous effect that the material web is reliably guided between the cylinders and—in contrast to a manual correction—the twist can no longer continue into the section between the rotatable pair of cylinders and the processing machine.

With respect to constructive considerations, the rotatable pair of cylinders could be arranged on a preferably motor-driven rotating device that is supported in a frame. The frame could be arranged on a stand that ensures a spacing of at least approximately 1000 mm from the removal station of the material web. This distance is required in order to provide twists that remain upstream of the rotatable pair of cylinders or upstream of the entire device, respectively, with sufficient space, as well as to promote a smooth transport of the web and to prevent oscillations thereof due to the relative speed between the material web and the material pack.

According to one particularly preferred embodiment of the invention, a stationary pair of cylinders is respectively arranged upstream and downstream of the rotatable pair of cylinders. This measure also ensures that twists or wrong material web connections produced after various processing steps are effectively shifted upstream of the device according to the invention. In addition, it is possible to further lower the probability of ever supplying a flawed material web to the processing machine such that downtimes of the processing machine can be prevented. In this context, it is particularly advantageous that the rotating device can be displaced between the two stationary pairs of cylinders together with the rotatable pair of cylinders along a frame. The two stationary pairs of cylinders may be respectively arranged in the region of the face sides of the frame. The distance between the pairs of cylinders depends on the width of the material web, wherein the ratio is no smaller than 1:8 and usually 1:10 or more. If the material web has the width of 100 mm, the pairs of cylinders would have to be spaced apart by a distance of at least 800 mm. These measures are related to the shift of the accidental or even intentional twists out of the frame region and their propagation within defined dimensions that depend on the properties of the material web.

In one particularly preferred embodiment of the device according to the invention with a rotatable and displaceable pair of cylinders and two stationary pairs of cylinders, it is necessary to displace the cylinders of the first and/or second stationary pair of cylinders and of the rotatable pair of cylinders into an open position and into a closed position. In the normal mode, i.e., if the respective sides of the material web are correctly positioned or supplied to the processing machine, respectively, the cylinders of the rotatable pair of cylinders are situated in the closed position and the rotatable pair of cylinders is arranged approximately in the center between the two stationary pairs of cylinders. This is relevant with respect to the detection of wrongly connected web ends.

the normal mode, the cylinders of both stationary pairs of cylinders are situated in the closed position, wherein said cylinders may be realized in the form of pinch rolls, and wherein the cylinders are pressed against one another in such a way that a continuous transport of the material web is ensured. The cylinders of both stationary pairs of cylinders may also be realized in the form of S-rolls, in which case a certain clamping effect is achieved by means of friction.

At least one detection device may be arranged upstream of the rotatable pair of cylinders in order to realize an automatic operating mode of the device according to the invention—without the presence of personnel. An optimization of the detection process could be achieved if a first detection device is arranged upstream of the first stationary pair of cylinders and a second detection device is arranged between the first stationary pair of cylinders and the rotatable pair of cylinders. After a flawed material web or a twisted supply thereof to the processing machine is detected, the detection devices may cause the rotatable pair of cylinders to turn by the required angle and thusly correct the flaw. The signals are preferably transmitted from the detection device to the rotating device in a contactless fashion. In essence, two signals that pertain to the surface of the material web on one hand and to the rotating direction on the other hand are transmitted to an external control device.

If the material web is twisted, the cylinders of the rotatable pair of cylinders are opened after the twist is detected by the detection device and the transmission of the corresponding signals, wherein the rotatable pair of cylinders is able to pass over the twist in the material web from its normal position in the direction of the first stationary pair of cylinders. The cylinders of the rotatable pair of cylinders can be moved into the closed position a short distance from the first stationary pair of cylinders such that the twist is situated between the rotatable pair of cylinders and the second stationary pair of cylinders. The distance between the first stationary pair of cylinders and the rotatable pair of cylinders should not lie below 100 mm. It should also be ensured that the rotatable pair of cylinders is positioned on a non-twisted section of the material web in order to prevent damages, kinks or tearing thereof.

As soon as the rotatable pair of cylinders has assumed its above-described closed position, the cylinders of the first stationary pair of cylinders are moved into the open position and the rotatable pair of cylinders is turned, wherein the twist of the material web between the rotatable pair of cylinders and the second stationary pair of cylinders is corrected. The rotation causes another twist to be created between the rotatable pair of cylinders and the first stationary pair of cylinders. However, this new twist in the material web passes through the first stationary pair of cylinders in the direction of the removal station because the cylinders of the first stationary pair of cylinders are still in the open position. The short distance between the first stationary pair of cylinders and the rotatable pair of cylinders is also advantageous in this respect because the new twist is subjected to tension and can be a shifted more easily in the direction of the removal station.

After the new twist has passed through the first stationary pair of cylinders, its cylinders are immediately moved back into the closed position such that a correctly positioned transport of the material web takes place between all pairs of cylinders in the device according to the invention and the rotatable pair of cylinders can be moved back into its normal position.

The device according to the invention is provided with two additional components for instances in which the material web contains two wrongly connected web ends, namely a cutting and connecting device and a material web reservoir that are arranged downstream of the rotatable pair of cylinders. A different operating mode of the device according to the invention is activated by an external control device that processes the signals of the detection device. A wrong connection between the ends of two material webs could lead to the underside of one material web being connected to the upper side of the other material web. If the incorrect position of the material web is a result of the underside of one material web being connected to the upper side of another material web and the material web is supplied without twists, a signal delivered by the detection device causes the material web to be stopped for approximately 1-3 seconds. During this time, the material web is severed, the rotatable pair of cylinders with the flawed material web is turned by 180° such that the upper side of the material web correctly points upward and the ends of the material webs are reconnected in the cutting and connecting device. During the cutting, turning and connecting processes, the processing machine is supplied from the material web reservoir. During the rotation of the rotatable pair of cylinders, a twist is created between the first stationary pair of cylinders and the rotatable pair of cylinders. This twist is corrected by moving the cylinders of the first stationary pair of cylinders into the open position such that the twist passes through the first stationary pair of cylinders in the direction of the removal station. However, the twist between the first stationary pair of cylinders and the rotatable pair of cylinders may also be corrected in the above-described fashion, namely by opening and moving the rotatable pair of cylinders toward the first stationary pair of cylinders such that the undesirable twist is shifted between the rotatable pair of cylinders and the second stationary pair of cylinders. Subsequently, the cylinders of the rotatable pair of cylinders are closed and turned such that the undesirable twist created between the first stationary pair of cylinders and the rotatable pair of cylinders passes through the open cylinders of the first pair of cylinders. The cylinders of the first pair of cylinders are then closed and the rotatable pair of cylinders is moved back into its normal position. After these processes, the material web travels through the device according to the invention with the upper side of the material web correctly pointing upward and is introduced into the processing machine in a correctly positioned fashion.

When an empty material pack is exchanged for a new material pack at the removal station, it is necessary to manually connect the material webs. In this case, the free end of the material web can be manually untwisted and bonded or sewn to the end of the material web contained in the new material pack in this fashion.

The detection device may consist of a CCD camera and/or a detection device based on laser technology and/or a capacitive measuring device and/or an inductive measuring device.

With respect to constructive considerations, the rotatable pair of cylinders and the rotating device may respectively form part of a slide that is displaced on the frame. The drive of the rotating device, the slide and the cylinders of the pairs of cylinders that can be moved into an open and a closed position may be realized with servomotors, particular a.c. servomotors. The detection device could transmit signals and commands for controlling the motion sequences to the servomotors via SPS or PC. With respect to the method, the above-mentioned objective is attained with the characteristics of the present invention. According to these characteristics, a method of the initially cited type is carried out, particularly by utilizing the device according to the invention, in such a way that the material web is turned by means of a rotatable pair of cylinders.

As described above with respect to the device disclosed, it was recognized that a rotation by means of a pair of cylinders makes it possible to largely preclude a flawed material web or a material web supplied in an incorrectly positioned fashion from reaching the processing machine.

It is particularly advantageous that the rotation by means of the rotatable pair of cylinders is preceded by the flaw detection by means of a detection device that acts upon the rotatable pair of cylinders or additional pairs of cylinders.

When utilizing the preferred embodiment of the device with two stationary pairs of cylinders that are arranged upstream and downstream of the rotatable pair of cylinders, an undesirable twist that causes the underside of the material web to incorrectly point upward could be corrected with the method according to the invention as described below:

detecting the twist generating a command for opening the cylinders of the rotatable pair of cylinders shifting the twist in the direction of the first stationary pair of cylinders by means of the rotatable pairs of cylinders stopping the rotatable pair of cylinders a short distance from the first stationary pair of cylinders closing the cylinders of the rotatable pair of cylinders such that the twist is situated between the rotatable pair of cylinders and the second stationary pair of cylinders opening the cylinders of the first stationary pair of cylinders turning the rotatable pair of cylinders such that the twist between the rotatable pair of cylinders and the second stationary pair of cylinders is "untwisted" or corrected and a new twist is created between the first stationary pair of cylinders, the cylinders of which are still open, and the rotatable pair of cylinders correcting the new twist between the first stationary pair of cylinders, the cylinders of which are still open, and the rotatable pair of cylinders shifting the twist in the direction of the removal station beyond the first stationary pair of cylinders, the cylinders of which are still open closing the cylinders of the first stationary pair of cylinders moving the rotatable pair of cylinders into its normal position in the direction of the second stationary pair of cylinders.

If the material web consists of two webs, the ends of which were wrongly connected to one another, i.e., if the underside of one material web was connected to the upper side of another material web, the correction would be carried out in a device according to the invention that comprises two additional stationary pairs of cylinders, a cutting and connecting device and a material web reservoir, namely as described below:

detecting the flawed connection, at which the upper side and the underside of the material webs were wrongly connected stopping the material web for approximately 1-3 seconds supplying the processing machine from the material web reservoir while the correction is carried out cutting the material web such that one end remains in the rotatable pair of cylinders and the other end remains in the cutting and connecting device turning the rotatable pair of cylinders such that a twist is created in the section between the first stationary pair of cylinders and the rotatable pair of cylinders connecting the corrected end of the material web to the material web situated in the cutting and connecting device additionally transporting the material web to the material web reservoir or the reprocessing machine, respectively correcting the new twist between the first stationary pair of cylinders and the rotatable pair of cylinders in accordance with the twist correction generating a command for opening the cylinders of the rotatable pair of cylinders shifting the twist in the direction of the first stationary pair of cylinders by means of the rotatable pair of cylinders stopping the rotatable pair of cylinders a short distance from the first stationary pair of cylinders closing the cylinders of the rotatable pair of cylinders such that the twist is situated between the rotatable pair of cylinders and the second stationary pair of cylinders opening the cylinders of the first stationary pair of cylinders turning the rotatable pair of cylinders such that the twist between the rotatable pair of cylinders and the second stationary pair of cylinders is "untwisted" or corrected and a new twist is created between the first stationary pair of cylinders, the cylinders of which are still open, and the rotatable pair of cylinders correcting the new twist between the first stationary pair of cylinders and the rotatable pair of cylinders opening the cylinders of the first stationary pair of cylinders shifting the twist in the direction of the removal station beyond the first stationary pair of cylinders, the cylinders of which are open closing the cylinders of the first stationary pair of cylinders moving the rotatable pair of cylinders into its normal position in the direction of the second stationary pair of cylinders.

The respective steps of the method are not limited to the two above-described embodiments. For example, it would also be conceivable that superimposed flaws occur, namely that the ends of two material webs are wrongly connected to one another and the material web is simultaneously twisted. In this case, the device according to the invention needs to be controlled differently. Adapted software programs can be prepared for various applications. It would also be conceivable, in particular, that several rotations by different angles are required—depending on the flaw pattern. In addition, the device according to the invention may be utilized as a pure deflection device in order to deflect the material web by different angles.

With respect to other advantageous variations of the method according to the invention, we refer to the general description of the device according to the invention or its embodiments, respectively. This general description discloses characteristics that are also relevant to the method according to the invention.

In summation, the device according to the invention and the method according to the invention make it possible to preclude the supply of flawed material webs, the underside of which incorrectly points upward, to the processing machine. The method and the device according to the invention also make it possible to carry out the correction while the processing machine is running, namely without requiring any personnel.

The characteristics of the present invention can be advantageously realized and additionally developed in different ways. Preferred embodiments and additional developments of the invention are discussed below in connection with the description of the two embodiments illustrated in the figures.

DESCRIPTION OF THE PREFERRED EMBODIMENTS

Figure 1:
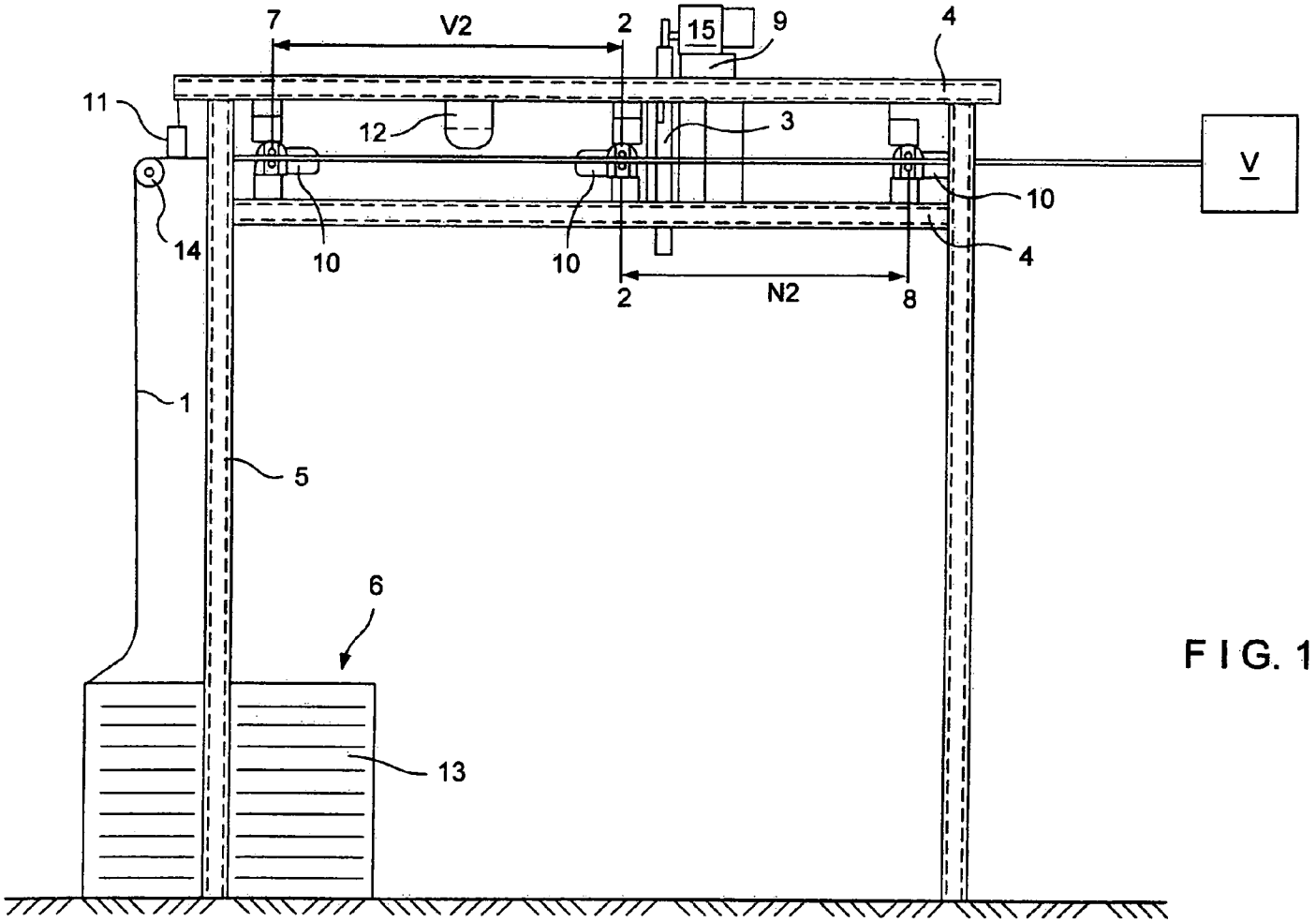
FIG. 1 illustrates a schematic side view of a first embodiment of a device according to the invention.
Figure 2:
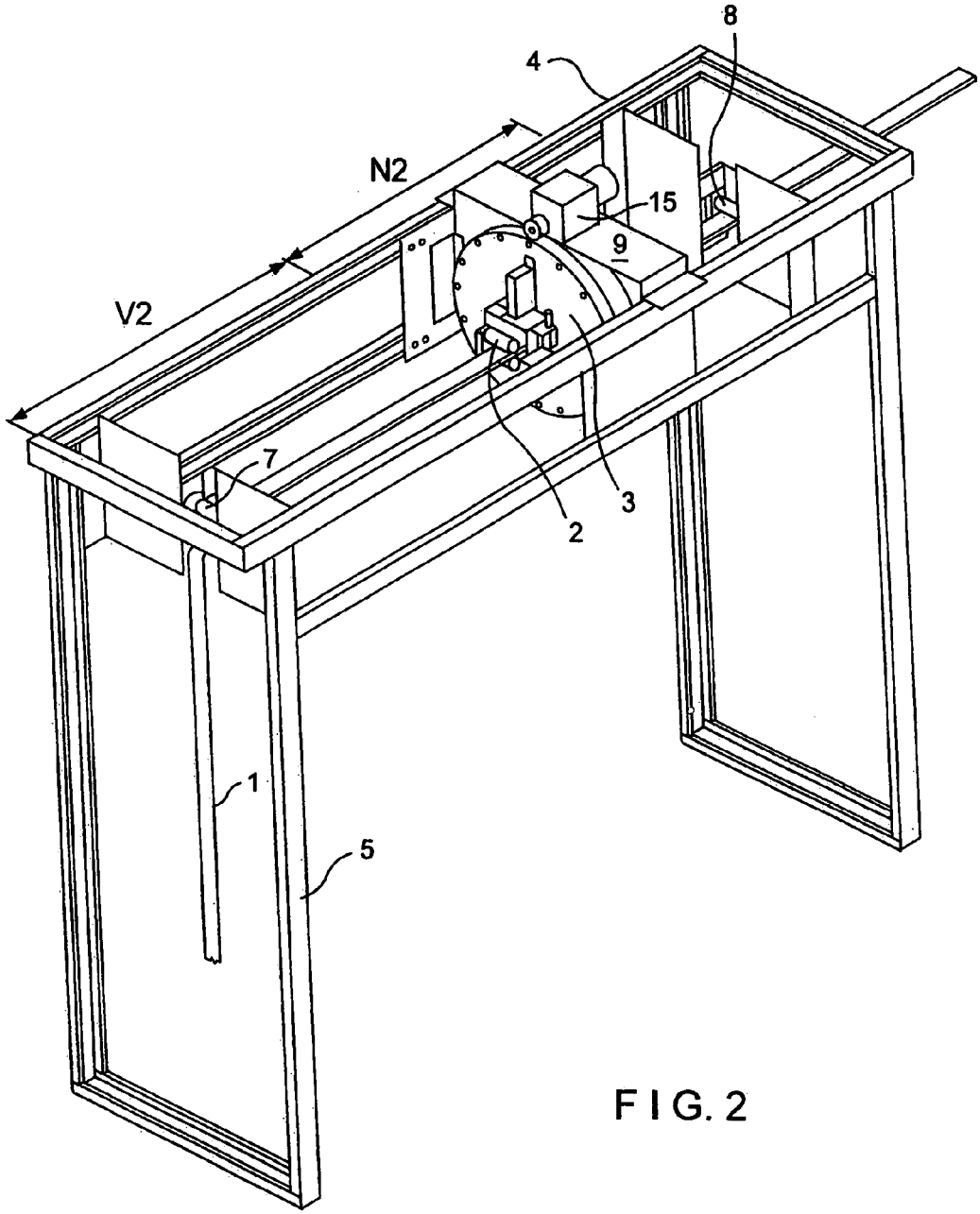
FIG. 2 is a schematic perspective representation of the object of FIG. 1.
Figure 3:
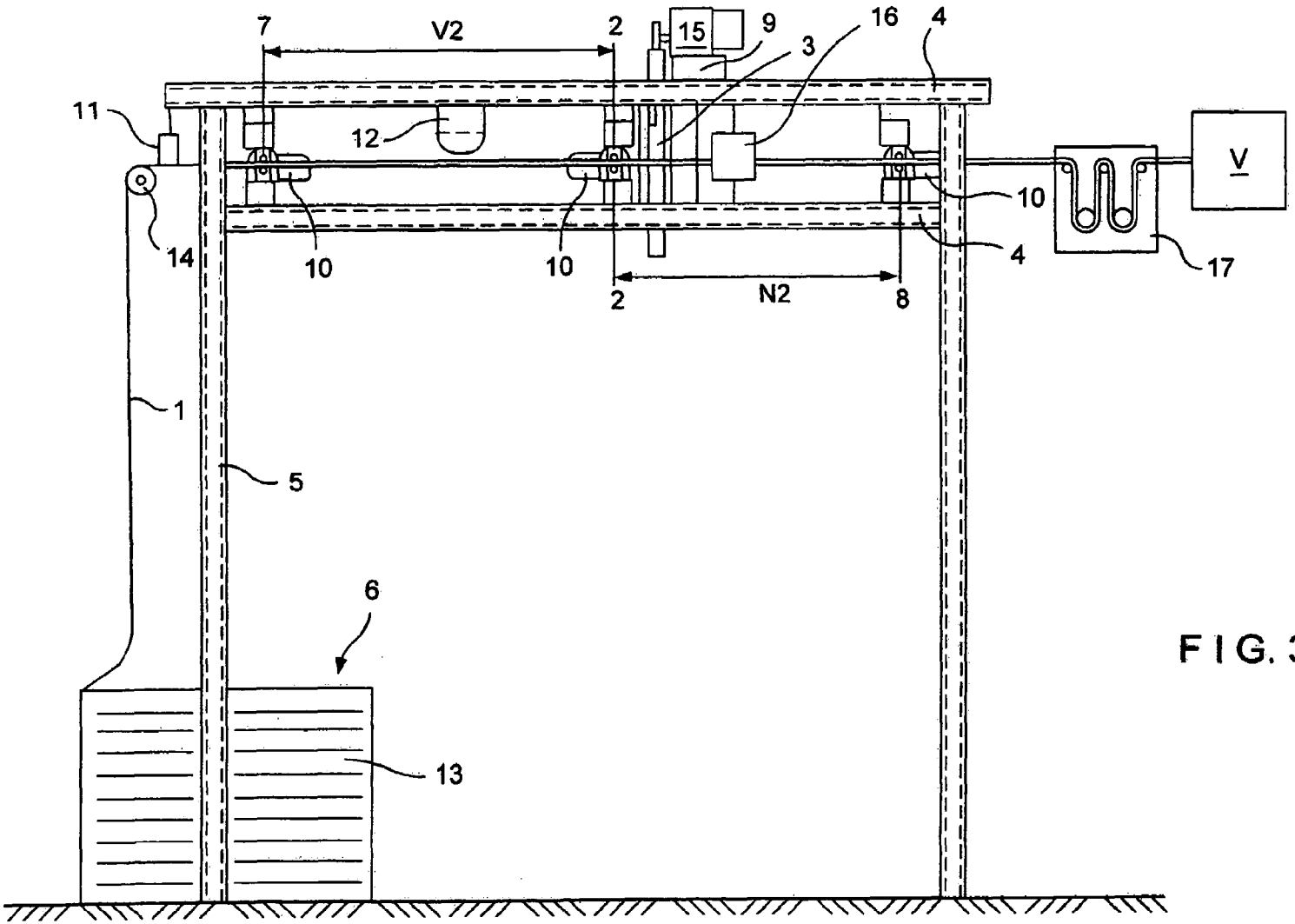
FIG. 3 is a schematic side view of a second embodiment of a device according to the invention that is equipped with additional components, namely a cutting and connecting device and a material web reservoir.

FIGS. 1-3 show two preferred embodiments of a device according to the invention for correcting a flexible material web 1 that is guided to a processing machine V, wherein the underside of the material web incorrectly points upward. The device comprises a rotatable pair of cylinders 2 that corrects the twist in the material web 1 by turning it about its longitudinal axis in such that the underside of the material web once again correctly point downward.

The rotatable pair of cylinders 2 is mounted on a rotating device 3 that is arranged on a frame 4. The frame 4 is fixed on a stand 5 that ensures a distance of at least approximately 1000 mm between the frame 4 and the removal station 6 of the material web 1.

A stationary pair of cylinders 7, 8 is respectively arranged upstream and downstream of the rotatable pair of cylinders 2, wherein the stationary pairs of cylinders are respectively arranged in the region of the face sides of the frame 4. The rotatable pair of cylinders 2 can be displaced along the frame 4 by means of a slide 9. Due to constructive requirements, the first stationary pair of cylinders 7 is spaced apart from the rotatable pair of cylinders 2 by approximately 2900 mm in FIG. 1.

The cylinders of the first and the second stationary pair of cylinders 7, 8 and of the rotatable pair of cylinders 2 can be moved into an open position and a closed position. This is required for the proper function of the described embodiment of the device according to the invention. The cylinders of all pairs of cylinders 2, 7, 8 are in the closed position when the device operates in the normal mode, namely when a flawless material web 1 is processed or the material web 1 is supplied to the processing machine in a correctly positioned fashion, respectively. Driving elements 10 in the form of servomotors are provided for opening and closing the pairs of cylinders 2, 7, 8 and can be independently controlled. The driving element 10 assigned to the rotatable pair of cylinders 2 serves for displacing the slide 9 and for driving the cylinders in order to transport the material web 1. The driving elements 10 assigned to the two stationary pairs of cylinders 7, 8 drive the cylinders in order to transport the material web 1. The opening and the closing of the pairs of cylinders 2, 7 and, if applicable, 8 takes place pneumatically.

In the described embodiment of the device according to the invention, a first detection device 11 is arranged in the immediate upstream vicinity of the first stationary pair of cylinders 7 and a second detection device 12 is arranged in the immediate upstream vicinity of the rotatable pair of cylinders 2 in order to detect a flawed material web 1 and/or the twisted supply thereof to the processing machine.

One essential aspect of the invention is the turning of the rotatable pair of cylinders 2. After detecting a flawed material web 1 and/or the twisted supply of the material web 1 to the processing device, the detection device 11, 12 delivers a signal to the rotatable pair of cylinders 2, wherein said signal leads to the correction of the twist in connection with a few other steps.

Two applications of the device are described below in an exemplary fashion:

A.

The material web 1 contains a twist such that the underside of the material web incorrectly points upward.

The twist is detected in the section V2 between the first stationary pair of cylinders 7 and the rotatable pair of cylinders 2. The cylinders of the rotatable pair of cylinders 2 are opened and the rotatable pair of cylinders 2 passes over the twist in the material web 1 in the direction of the first stationary pair of cylinders 7.

After passing over the twist, the rotatable pair of cylinders 2 comes to a standstill approximately 100 mm from the first stationary pair of cylinders 7 and its cylinders are closed. The twist is now situated between the rotatable pair of cylinders 2 and the second stationary pair of cylinders 8. The cylinders of the first stationary pair of cylinders 7 are moved into the open position and the rotatable pair of cylinders 2 is turned. This causes the twist in the material web 1 that is situated in the section N2 between the rotatable pair of cylinders 2 and the second stationary pair of cylinders 8 to be corrected or untwisted, respectively. While the material web 1 is untwisted in the section N2, a new twist is created in the section V2, namely within the approximately 100 mm spacing between the first stationary pair of cylinders 7 and the rotatable pair of cylinders 2, and passes through the first stationary pair of cylinders 7 in the direction of the removal station 6. Subsequently, its cylinders are immediately moved back into the closed position. This results in a flawless progression of the material web 1 between all pairs of cylinders 2, 7, 8. The rotatable pair of cylinders 2 can now be moved back into its normal position after being triggered to do so by corresponding signals. When a new material pack 13 is placed into the removal station 6 and the end of the material web contained therein is connected to the material web contained in the old material pack, the twists situated upstream of the device can be manually corrected before the connection is produced.

B.

The material web 1 contains two web ends that were incorrectly connected to one another, i.e., the underside of one material web was wrongly connected to the upper side of the other material web. For such instances, the second embodiment of the device according to the invention that is illustrated in FIG. 3 comprises a cutting and connecting device 16, as well as a material web reservoir 17, both of which are arranged downstream of the rotatable pair of cylinders 2. The cutting and connecting device 16 is arranged between the second stationary pair of cylinders 8 and the rotatable pair of cylinders 2. The material web reservoir 17 is arranged between the second stationary pair of cylinders 8 and the processing machine V and comprises three stationary upper cylinders and two loosely suspended lower cylinders such that the material web 1 forms loops.

The wrong connection or the twist in the material web is detected by the detection devices 11, 12 in the section V2 between the first stationary pair of cylinders 7 and the rotatable pair of cylinders 2. Corresponding signals generated by the detection devices are transmitted to a not-shown external control device for controlling the driving elements 10 and the servomotor 15 and cause the material web 1 to be stopped for approximately 1-3 seconds. During this time, the material web 1 is severed in the region of the connection in the cutting and connecting device 16, and the processing machine V is supplied with the material web 1 situated in the material web reservoir 17.

After the material web has been severed, one web end is held in the rotatable pair of cylinders 2 and the other web end is held in the cutting and connecting device 16. The rotatable pair of cylinders 2 is now turned by 180° such that the upper side of the material web 1 now correctly points upward in the section N2 and a new twist is created in the section V2 between the first stationary pair of cylinders 7 and the rotatable pair of cylinders 2.

After this rotation of the rotatable pair of cylinders, the web ends are connected in the cutting and connecting device 16 and the material web 1 is additionally transported to the processing machine V or to the material web reservoir 17, respectively. The twist situated in the section V2 between the first stationary pair of cylinders 7 and the rotatable pair of cylinders 2 is corrected by moving the cylinders of the first stationary pair of cylinders 7 into the open position such that the twist is able to pass through the cylinders of the first stationary pair of cylinders. The twist correction is carried out, in particular, as described above with reference to example A, namely by opening the cylinders of the rotatable pair of cylinders 2 such that the rotatable pair of cylinders 2 is able to pass over the twist in the material web 1 that lies in the section of V2, namely in the direction of the first stationary pair of cylinders 7. After passing over the twist, the rotatable pair of cylinders 2 comes to a standstill approximately 100 mm from the first stationary pair of cylinders 7 and its cylinders are closed. The twist is now situated between the rotatable pair of cylinders 2 and the second stationary pair of cylinders 8. The cylinders of the first stationary pair of cylinders 7 are moved into the open position and the rotatable pair of cylinders 2 is turned by 180°. During this process, the twist in the material web 1 in the section N2 between the rotatable pair of cylinders 2 and the second stationary pair of cylinders 8 is corrected or untwisted, respectively. It goes without saying that the rotation needs to take place in the corresponding direction in order to ensure that the upper side of the material web is turned into the correct position.

While the material web 1 is untwisted in the section N2, a new twist is created in the section V2. This twist is created within the approximately 100 mm spacing between the first stationary pair of cylinders 7 and the rotatable pair of cylinders 2 and passes through the first stationary pair of cylinders 7 in the direction of the removal station 6. Subsequently, the cylinders of the first stationary pair of cylinders are immediately moved back into the closed position. This results in a flawless progression of the material web 1 between all pairs of cylinders 2, 7, 8. The rotatable pair of cylinders 2 can now be moved back into its normal position in the direction of the second stationary pair of cylinders 8. This is also triggered by corresponding signals.

In both examples A, B, the cylinders of the second stationary pair of cylinders 8 always remain closed.

In the described embodiment, the detection devices 11 and 12 consist of CCD cameras. A.c. servomotors 10 are provided for driving the rotating device 3, the slide 9 and the cylinders of the pairs of cylinders 2, 7, 8 that can be moved into the open and the closed position. The detection devices 11, 12 transmit signals and commands for controlling the motion sequences to the servomotors 10 via SPS.

The removal station 6 contains a material pack 13, from which the material web 1 is transported to the invention via a deflection roll 14.

With respect to other characteristics that are not illustrated in the figures, we refer to the general portion of the description. It should also be mentioned that the characteristics of the invention are not limited to the previously described embodiments. On the contrary, it is possible to realize various operating modes of the device, as well as corresponding constructive modifications.

While the foregoing description and drawings represent the present invention, it will be obvious to those skilled in the art that various changes may be made therein without departing from the true scope of the present invention.

LIST OF THE REFERENCE SYMBOLS

1 Material web
2 Rotatable pair of cylinders
3 Rotating device
4 Frame
5 Stand
6 Removal station
7 First stationary pair of cylinders
8 Second stationary pair of cylinders
9 Slide for 2, 3
10 Driving elements or servomotors for the cylinders
11 First detection device
12 Second detection device
13 Material pack
14 Deflection roll
15 Servomotor for the rotating device
16 Cutting and connecting device
17 Material web reservoir
V Processing machine
V2 Section 7-2
N2 Section 2-8

What is claimed is:

1. A device for correcting a flexible material web that is guided to a processing machine, wherein the underside of the material web incorrectly points upward due to wrongly connected web ends or due to twisting, comprising:

a rotatable pair of cylinders that is arranged on a rotating device fixed on a frame and causes the material web to be turned by 180° about its longitudinal axis such that the underside of the material web once again correctly point downward; and a stationary pairs of cylinders that are respectively arranged upstream and downstream of the rotatable pair of cylinders, particularly in the region of the respective face sides of the frame, wherein the rotatable pair of cylinders can be displaced along the frame, and wherein the cylinders of the first and/or the second stationary pair of cylinders and of the rotatable pair of cylinders can be moved into an open position and a closed position.

2. The device according to claim 1, wherein the frame is fixed on a stand that ensures a distance of approximately 1000 mm between the frame and the removal station of the material web.

3. The device according to claim 1, wherein the cylinders of the rotatable pair of cylinders are situated in the closed position in the normal operating mode.

4. The device according to claim 1, wherein the rotatable pair of cylinders is positioned approximately in the center between the two stationary pairs of cylinders.

5. The device according to claim 1, wherein the cylinders of both stationary pairs of cylinders are situated in the closed position in the normal operating mode.

6. The device according to claim 1, wherein at least one detection device for detecting a flawed material web and/or the incorrectly positioned supply thereof is arranged upstream of the rotatable pair of cylinders.

7. The device according to claim 6, wherein a first detection device is arranged upstream of the first stationary pair of cylinders, and wherein a second detection device is arranged between the first stationary pair of cylinders and the rotatable pair of cylinders.

8. The device according to claim 6, wherein the detection device causes the rotatable pair of cylinders to turn in order to correct the flaw after the detection of a flawed material web and/or the incorrectly positioned supply of the material web, particularly by transmitting corresponding signals.

9. The device according to claim 6, wherein the material web contains a twist.

10. The device according to claim 9, wherein the detection device causes the cylinders of the rotatable pair of cylinders to open after the detection of a twist in the material web, wherein the rotatable pair of cylinders passes over the twist in the material web in the direction of the first stationary pair of cylinders, and wherein the cylinders of the rotatable pair of cylinders are moved into the closed position when it is spaced apart from the first stationary pair of cylinders by a short distance of, in particular, approximately 100 mm such that the twist is situated between the rotatable pair of cylinders and the second stationary pair of cylinders.

11. The device according to claim 10, wherein the cylinders of the first stationary pair of cylinders are moved into the open position as soon as the rotatable pair of cylinders has assumed its closed position a short distance therefrom, and wherein the rotatable pair of cylinders is turned by 180° in order to correct the twist in the material web between the rotatable pair of cylinders and the second stationary pair of cylinders.

12. The device according to claim 11, wherein the new twist in the material web being created between the first stationary pair of cylinders, the cylinders of which are still open, and the rotatable pair of cylinders due to the turning of the rotatable pair of cylinders passes through the first rotatable pair of cylinders in the direction of the removal station, wherein the cylinders of the first stationary pair of cylinders are immediately moved back into the closed position such that a flawless progression of the material web is achieved between all pairs of cylinders and the rotatable pair of cylinders can be moved back into its normal position.

13. The device according to claim 10, wherein the material web contains two web ends that are wrongly connected to one another, in particular, such that the underside of one material web is connected to the upper side of the other material web.

14. The device according to claim 13, wherein a cutting and connecting device as well as a material web reservoir are arranged downstream of the rotatable pair of cylinders.

15. The device according to claim 14, wherein the cuffing and connecting device is arranged between the second stationary pair of cylinders and the rotatable pair of cylinders.

16. The device according to claim 14, wherein the material web reservoir is arranged between the second stationary pair of cylinders and the processing machine.

17. The device according to claim 14, wherein the detection device causes the material web to be stopped for approximately 1-3 seconds after the detection of the wrong connection between the web ends of the material web, wherein the processing machine is supplied from the material web reservoir during this time and the material web (1) is severed in the cutting and connecting device, preferably in the region of the wrong connection or upstream thereof.

18. The device according to claim 17, wherein the web ends are respectively held in the rotatable pair of cylinders and in the cutting and connecting device.

19. The device according to claim 18, wherein the rotatable pair of cylinders is turned by 180 °, wherein a twist is created in a section between the first stationary pair of cylinders and the rotatable pair of cylinders, and wherein the upper side of the material web (1) now correctly points upward in the section.

20. The device according to claim 18, wherein the material web ends are connected in the cutting and connecting device and the material web is additionally transported to the processing machine or to the material reservoir, respectively.

21. The device according to claim 20, wherein the twist situated in the section between the first stationary pair of cylinders and the rotatable pair of cylinders is corrected by moving the cylinders of the first stationary pair of cylinders into the open position in order to enable the twist to pass though the cylinders of the first stationary pair of cylinders.

22. The device according to claim 6, wherein the detection devices consist of CCD cameras and/or detection devices based on laser technology and/or capacitive measuring devices and/or inductive measuring devices.

23. The device according to claim 1, wherein the rotatable pair of cylinders and/or the rotating device form/forms part of a slide that can be displaced on the frame.

24. The device according to claim 6, wherein servomotors, a.c. motors, are provided for driving the rotating device, the slide and the cylinders of the pairs of cylinders that can be moved into the open and the closed position.

25. The device according to claim 24, wherein the detection device transmits signals and commands for controlling the motion sequences to the servomotors via SPS or PC.

26. A method for correcting a flexible material web that is guided to a processing machine, wherein the underside of the material web incorrectly points upward due to wrongly connected web ends or due to twisting, wherein the material web is turned at least once about its longitudinal axis in such a way that the underside of the material web once again correctly points downward and the correct upper side of the material web is transported to the processing machine, comprising the steps of: turning the material web by 180° by a rotatable pair of cylinders in a section between at least one stationary pair of cylinders and a rotatable pair of cylinders such that the flaw is corrected and that the cylinders of the at least one stationary pair of cylinders and of the rotatable pair of cylinders can be moved into an open position and a closed position.

27. The method according to claim 26, wherein the flaw in the material web is detected and commands are transmitted to the pairs of cylinders in dependence on the detected flaw.

28. The method according to claim 27, wherein the material web contains an undesirable twist, wherein the cylinders of the rotatable pair of cylinders are opened after the detection of the twist in the material web.

29. The method according to claim 28, wherein the rotatable pair of cylinders passes over the twist in the material web in the direction of the first stationary pair of cylinders, and wherein its cylinders are moved into the closed position a short distance from the first stationary pair of cylinders such that the twist is situated between the rotatable pair of cylinders and the second stationary pair of cylinders.

30. The method according to claim 29, wherein the cylinders of the first stationary pair of cylinders are moved into the open position after the cylinders of the rotatable pair of cylinders arranged adjacent to the first stationary pair of cylinders reach the closed position, and in that the rotatable pair of cylinders is subsequently turned in order to correct the twist in the material web between the rotatable pair of cylinders and the second stationary pair of cylinders.

31. The method according to claim 30, wherein a new twist is created between the first stationary pair of cylinders, the cylinders of which are still open, and the rotatable pair of cylinders after the rotatable pair of cylinders is turned, wherein the new twist is corrected by the new twist in the material web passing through the cylinders of the first stationary pair of cylinders in the direction of the removal station and by moving the cylinders of the first stationary pair of cylinders back into the closed position immediately thereafter such that a flawless progression of the material web is achieved between all pairs of cylinders and the rotatable pair of cylinders can be moved back into its normal position in the direction of the second stationary pair of cylinders.

32. The method according to claim 27, wherein the material web contains two web ends that were wrongly connected, such that the underside of one material web is connected to the upper side of the other material web, wherein the material web is stopped for 1-3 seconds after the detection of the wrong connection between the web ends, wherein the material web is severed, wherein the rotatable pair of cylinders is turned by 180° together with the twisted material web, wherein the web ends are correctly connected to one another, wherein the processing machine is supplied with the material web from a material web reservoir during these processes, and wherein the material web is additionally transported to the processing machine or to the material web reservoir, respectively, after the connection between the web ends is produced.

33. The method according to claim 32, wherein the turning of the rotatable pair of cylinders causes a twist to be created in the section between the first stationary pair of cylinders and the rotatable pair of cylinders, wherein said twist is corrected by opening the cylinders of the rotatable pair of cylinders and the rotatable pair of cylinders passing over the twist in the direction of the pair of cylinders, and wherein the cylinders of the rotatable pair of cylinders are moved into the closed position a short distance from the first stationary pair of cylinders such that the twist is now situated in the section.

34. The method according to claim 33, wherein the cylinders of the first stationary pair of cylinders are moved into the open position after the cylinders of the rotatable pair of cylinders arranged adjacent to the first stationary pair of cylinders reach the closed position, and in that the rotatable pair of cylinders is subsequently turned by 180° in order to correct the twist in the material web in the section such that the respective sides of the material web correctly point upward and downward.

35. The method according to claim 34, wherein a new twist is created in the section after the rotatable pair of cylinders is turned, wherein the new twist is corrected by opening the cylinders of the first stationary pair of cylinders such that the new twist in the material web is able to pass though the cylinders of the first stationary pair of cylinders in the direction of the removal station and by moving the cylinders of the first stationary pair of cylinders back into the closed position immediately thereafter such that a flawless progression of the material web is achieved between all pairs of cylinders and the rotatable pair of cylinders can be moved back into its normal position in the direction of the second stationary pair of cylinders.

* * * * *